US012760531B2

(12) United States Patent
Jasinski

(10) Patent No.: US 12,760,531 B2
(45) Date of Patent: Oct. 13, 2026

(54) PROTECTIVE SYSTEMS AND METHODS OF FORMING PROTECTIVE SYSTEMS ON AN OUTDOOR WOODEN STRUCTURE

(71) Applicant: CB Interests Inc., Woodstock (CA)

(72) Inventor: Chris Jasinski, Woodstock (CA)

(73) Assignee: CB Interests Inc., Woodstock (CA)

( * ) Notice: Subject to any disclaimer, the term of this patent is extended or adjusted under 35 U.S.C. 154(b) by 138 days.

(21) Appl. No.: 18/510,557

(22) Filed: Nov. 15, 2023

(65) Prior Publication Data

US 2024/0159064 A1 May 16, 2024

Related U.S. Application Data

(60) Provisional application No. 63/425,978, filed on Nov. 16, 2022.

(51) Int. Cl.

| | |
|---|---|
| ***E04B 1/66*** | (2006.01) |
| ***E04B 1/98*** | (2006.01) |
| ***E04F 15/02*** | (2006.01) |

(52) U.S. Cl.
CPC ..... *E04F 15/02183* (2013.01); *E04B 1/66* (2013.01); *E04B 1/98* (2013.01)

(58) Field of Classification Search
CPC ..... E04F 15/02183; E04F 15/02016; E04F 15/12; E04F 11/17; E04F 2015/0205; E04B 1/66; E04B 1/98; B32B 3/10; B32B 3/14; B32B 3/16; B32B 3/18; B32B 3/22; B32B 3/26; B32B 3/266; B32B 2264/02; B32B 2264/0207; B32B 2264/0221; B32B 2264/0292; B32B 2274/00; B32B 2307/51; B32B 2307/726; Y10T 428/24355; Y10T 428/24372; Y10T 428/24405
USPC ..... 428/141, 143, 147
See application file for complete search history.

(56) References Cited

U.S. PATENT DOCUMENTS

| | | | |
|---|---|---|---|
| 8,915,671 B2 | 12/2014 | Weaver | |
| 9,957,670 B2 | 5/2018 | Weaver | |

FOREIGN PATENT DOCUMENTS

| | | | | |
|---|---|---|---|---|
| CA | 1306595 C | * | 8/1992 | |
| CA | 3028082 A1 | * | 6/2020 | ..... E04F 19/061 |
| CN | 105780626 A | * | 7/2016 | ..... B32B 9/002 |
| WO | WO-2011028586 A1 | * | 3/2011 | ..... C08G 18/6677 |

OTHER PUBLICATIONS

Machine translation of CN 105780626. Obtained from EPO. (Year: 2016).*

* cited by examiner

*Primary Examiner* — Megha M Gaitonde
(74) *Attorney, Agent, or Firm* — Smart & Biggar LP

(57) ABSTRACT

Protective systems for outdoor wooden structures and methods of forming protective systems on outdoor wooden structures are described herein. The protective systems include a first layer covering at least a portion of a top surface of the outdoor wooden structure. The first layer includes a first elastomeric composition. The protective system also include a second layer that includes an elastomeric granular composition. The elastomeric granular composition includes a second elastomeric composition and a granular material.

13 Claims, 17 Drawing Sheets

PROTECTIVE SYSTEMS AND METHODS OF FORMING PROTECTIVE SYSTEMS ON AN OUTDOOR WOODEN STRUCTURE

CROSS-REFERENCE

The present application claims priority to U.S. Provisional Patent Application No. 63/425,978 entitled Systems, Compositions and Methods of Forming a Water-Permeable, Protective Layer on an Outdoor Wooden Structure, filed on Nov. 16, 2022, the entire contents of which are incorporated by reference herein for all purposes.

TECHNICAL FIELD

The embodiments disclosed herein relate to protective systems and methods of forming protective systems on a structure, and more specifically, to two-layer protective systems and methods of forming two-layer protective systems on outdoor wooden structures.

BACKGROUND

Most outdoor wooden structures, such as decks and outdoor wooden staircases, are made of pressure-treated wood and prone to damage and/or discoloration caused by environmental conditions like exposure to ultraviolet (UV) light from the sun and water, as well as non-environmental conditions such as wear and tear.

There are many different coating products currently on the market, such as urethanes and paints, that can be directly applied to wooden structures to protect them from damage and/or discoloration. Unfortunately, these products are temporary solutions that either wear off due to wear and tear caused by pedestrian traffic or degrade due to UV light Further, these coatings do not provide long term protection to address structural failure of the wooden structures, for example at points on the structure where two boards abut each other or where screws, fasteners, or the like are exposed. Structural failure of the wooden structure creates maintenance issues for owners that are undesirable.

Composite and all-plastic deck boards containing a combination of wood, plastic and additives have been developed to improve the aesthetics of outdoor structures and with a focus to prolong the lifespan of the visible surface. To install these plastic deck boards onto an existing deck, the old pressure treated deck boards first need to be removed. This creates significant potentially toxic landfill. A plastic deck board "topcoat" does little to protect the underlaying wooden structure. Further, the use of plastic deck boards is potentially harmful to the environment. Composite deck boards are also not completely immune to the aforementioned problems associated with wooden outdoor structures. For each of these reasons, an alternative to plastic composite and all-plastic deck boards is desirable.

There is a need for new and improved protective systems for outdoor wooden structures.

SUMMARY

In accordance with a broad aspect, a two-layer protective system for an outdoor wooden structure is described herein. The two-layer protective system includes a first layer covering at least a portion of a top surface of the outdoor wooden structure. The first layer includes a first elastomeric composition. The system also includes a second layer placed on a top surface of the first layer. The second layer includes an elastomeric granular composition including a second elastomeric composition and a granular material.

In at least one embodiment, the second layer further includes a plurality of tiles placed on the top surface of the first layer and the elastomeric granular composition surrounds at least a portion of the plurality of tiles to form a containment field to inhibit the tiles from moving laterally.

In at least one embodiment, the plurality of tiles are spaced apart from one another on the top surface of the first layer to form gaps therebetween.

In at least one embodiment, the system further comprises spacers positioned in the gaps.

In at least one embodiment, the elastomeric granular composition is positioned in the gaps.

In at least one embodiment, the system further includes a plurality of pads positioned below the plurality of tiles and on the fop surface of the first layer to create a space between a bottom surface of each of the tiles and the top surface of the first layer and the pads have a height sufficient to provide for water to pass through the space and across the top surface of the first layer.

In at least one embodiment, a top surface of each of the plurality of tiles co-operates with each other tile of the plurality of tiles to form at least a portion of a top surface of the protective system, and the elastomeric granular composition in the gaps between the tiles also forms at least a portion of the top surface of the protective system.

In at least one embodiment, the first layer covers at least a portion of a side surface of the outdoor wooden structure.

In at least one embodiment, the second layer includes a skirt extending downwardly in front of at least the portion of the first layer on the side surface of the outdoor wooden structure.

In at least one embodiment, the urethane goes through many freeze thaw cycles without losing elasticity.

In at least one embodiment, the granular material comprises a washed aggregate material.

In at least one embodiment, the elastomeric granular composition includes about 20 parts of the granular material and about 1 part of the second elastomeric composition.

In accordance with a broad aspect, a method of forming a two-layer protective system on an outdoor wooden structure is described herein. The method includes forming a first layer of the protective system by applying a first elastomeric composition to at least a top surface of the outdoor wooden structure, pouring the elastomeric granular composition onto the top surface of the first layer, the elastomeric granular composition comprising a second elastomeric composition and a granular material, and allowing the elastomeric granular composition to cure on the top surface of the first layer and form a second layer of the protective system.

In at least one embodiment, after applying the first elastomeric composition to the top surface of the outdoor wooden structure, the method also include arranging for at least one barrier to be positioned around at least a portion of a perimeter of the existing wooden structure, each of the at least one barrier providing a cavity for enclosing the elastomeric granular composition on top of the first layer of the protective system, wherein pouring the elastomeric granular composition the elastomeric granular composition onto the top surface of the first layer includes pouring the elastomeric granular composition into the cavity.

In at least one embodiment the method also includes, before pouring the elastomeric granular composition, forming a tile field on the top surface of the first layer by placing a plurality of tiles on the top surface of the first layer, where the cavity provided by the at least one barrier at least partially surrounding the tile field and forming a containment field to inhibit the tiles from moving laterally once cured.

In at least one embodiment, forming the tile field on the top surface of the first layer includes centering the tile field on the top surface of the first layer, the tile field having a surface area that is smaller than a surface area of a top surface of the existing outdoor wooden structure.

In at least one embodiment, after centering the tile field on the top surface of the first layer, pouring the elastomeric granular composition onto the top surface of the first layer covers a remaining surface area of the top surface of the existing outdoor wooden structure uncovered by the tile field.

In at least one embodiment, placing the plurality of tiles on the top surface of the first layer includes spacing apart each tile of the plurality of tiles from each other tile on the top surface of the first layer to form a gap between any two adjacent tiles.

In at least one embodiment, pouring the elastomeric granular composition onto the top surface of the first layer includes pouring the elastomeric granular composition into each of the gaps between the tiles.

In at least one embodiment, placing the plurality of tiles on the top surface of the first layer includes placing the plurality of tiles onto a plurality of pads, each pad being positioned below at least one tile of the plurality of tiles and on the fop surface of the first layer to form a space between a bottom surface of the at least one tile and the top surface of the first layer, each pad having a height sufficient to provide for water to pass through the space and across the top surface of the first layer.

In at least one embodiment, the arranging for the at least one barrier around at least a portion of the perimeter of the existing wooden structure includes building the at least one barrier to extend downwardly in front of at least a portion of a side surface of the outdoor wooden structure such that a portion of the cavity extends downwardly in front of the at least a portion of the side surface of the outdoor wooden structure, and pouring the elastomeric granular composition onto the top surface of the first layer include and pouring the elastomeric granular composition within the portion of the cavity that extends downwardly in front of the at least a portion of the side surface of the outdoor wooden structure to form a skirt around the at least a portion of the side surface of the outdoor wooden structure.

In accordance with a broad aspect, a wooden outdoor structure is described herein. The wooden outdoor structure includes a deck frame supported above a ground by a plurality of deck posts; and a two-layer protective system covering at least a portion of a top surface of the deck frame. The two-layer protective system includes a first layer covering at least a portion of a top surface of the outdoor wooden structure. The first layer includes a first elastomeric composition. The system also includes a second layer placed on a top surface of the first layer. The second layer includes an elastomeric granular composition including a second elastomeric composition and a granular material.

These and other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

DETAILED DESCRIPTION

Figure 1A:
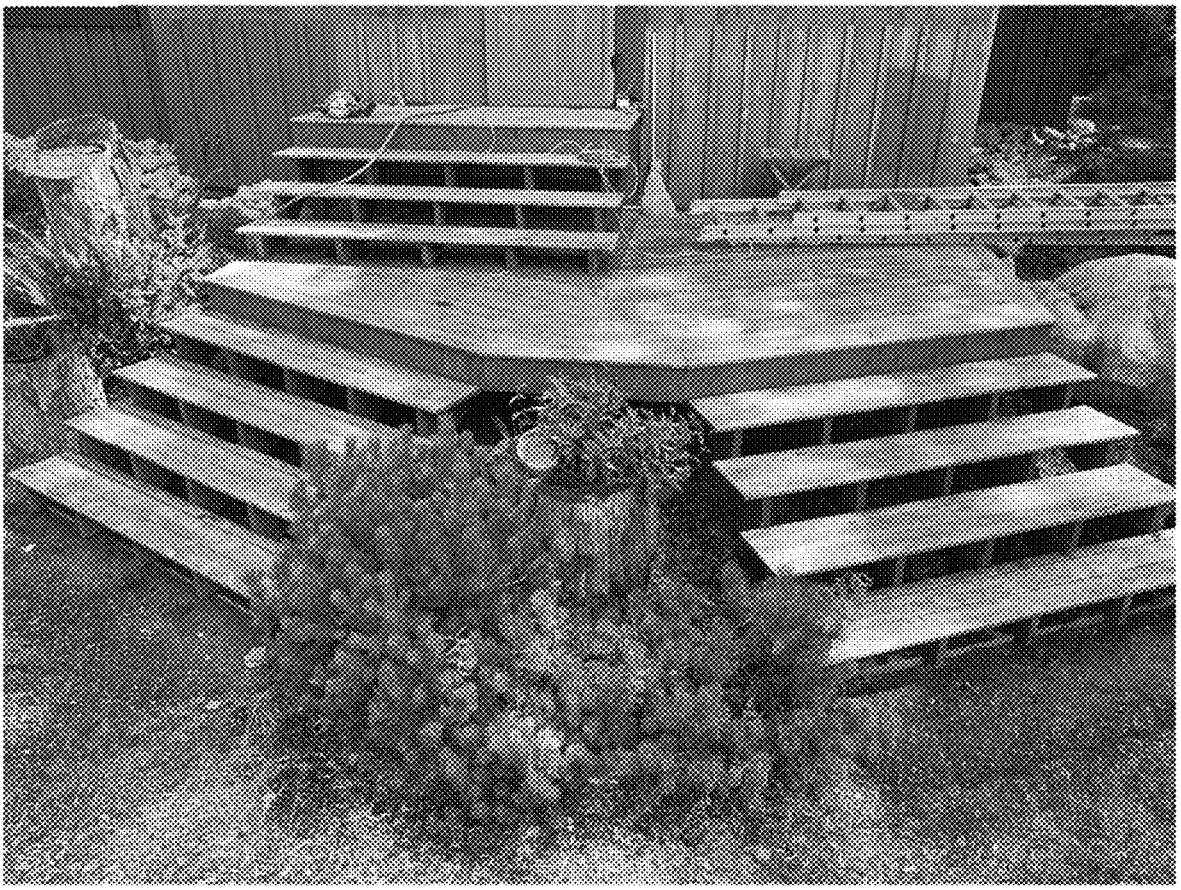
FIG. 1A shows a perspective view of two existing, elevated outdoor wooden structures and connecting staircases.

Various systems, apparatus and processes will be described below to provide an example of one or more embodiments. No embodiment described below limits any claimed embodiment and any claimed embodiment may cover systems, apparatus, compositions or processes that differ from those described below. The claimed embodiments are not limited to systems, apparatus, compositions or processes having all of the features of any one system, apparatus, composition or process described below or to features common to multiple or all of the systems, apparatus, compositions or processes described below. It is possible that a system, apparatus, composition or process described below is not an embodiment of any claimed embodiment. Any embodiment disclosed below that is not claimed in this document may be the subject matter of another protective instrument, for example, a continuing patent application, and the applicants, inventors or owners do not intend to abandon, disclaim or dedicate to the public any such embodiment by its disclosure in this document.

Protective Systems on an Outdoor Wooden Structure

Protective systems and processes of forming protective systems that include a two-layers for an outdoor wooden structure are described herein.

Existing protective coatings for wooden structures are not designed to withstand prolonged exposure to UV light and pedestrian traffic. Therefore, a two-layer solution is described herein for protecting wooden structures, the first layer being designed to protect the underlying wooden structure from standing water, and the second layer being designed to protect the first layer from UV light and pedestrian traffic.

Herein, the term "outdoor wooden structure" includes outdoor structures that receive pedestrian traffic and are primarily made of wood, such as but not limited to a deck, a porch, a staircase (e.g., steps of the staircase), a boardwalk, a dock or the like.

Water often contributes to degradation of existing outdoor, wooden structures and their need to be replaced. To provide protection against water damage, the upper layer of the protective systems described herein is water permeable to help control and direct the flow of water over and/or through the existing outdoor wooden structure.

For example, in the systems described herein, the upper layer includes an elastomeric composite material, described in greater detail below, mixed with a non-porous granular material. Once mixed together, granules of the granular material are coated with a thin (e.g. in a range of about 0.005 to about 0.05 inches) layer of an elastomeric composition. After the composite of the granular material and the elastomeric composition is installed on the existing outdoor structure, water is able to pass through pores formed between contact points of each granule with one or more other granules. Water travels through these pores from an upper surface of the upper layer to a lower layer directly applied to the existing wooden structure.

The lower layer may be applied to at least a top surface, and optionally one or more side surfaces, of the existing outdoor structure. The lower layer (e.g. a polyurethane coating) blocks water from being absorbed into the existing outdoor wooden structure (e.g. deck boards). By coating the top surface of the existing outdoor wooden structure, but not a bottom surface, with the lower layer, water is blocked from entering the wooden structure but the wooden structure can still, for example, receive air from the underside and expand and contract with changing environmental conditions to absorb and release moisture in a natural manner.

The two-layer protective systems described herein also provide a hard and flexible protective outer surface that both accommodates to movement of the underlying wooden structure and inhibits damage caused by environmental and non-environmental factors.

For example, in cold climate regions of the world, where environmental temperature shifts seasonally, ground heaving occurs. The resulting displacement of soil (e.g. to a depth of up to about four feet) can cause significant damage to absolutely rigid ground structures. Additionally, in rainy seasons, ground swell may occur, also causing soil displacement.

Structures positioned on the ground surface, and structures that are supported above the ground surface, need to be flexible to accommodate to the shifting ground and avoid catastrophic failure. The protective systems described herein are flexible to provide accommodation to movement of the underlying structure by, for example, being polyurethane-based systems. Polyurethane is well known as a flexible binding resin with high bending capacity and cushioning effect.

The protective systems described herein also protect the underlying wooden structure from compressive loading, including static loading of objects placed on top the protective system and from live loading of pedestrian or vehicular traffic thereon. The protective systems described herein have the strength to provide protection from compressive loading, for example, by including a granular material (e.g. a non-organic granular material such as an aggregate, a rubber, or the like, or an organic granular material such as crushed sea shells, crushed walnut shells, or the like) mixed with a polyurethane. Polyurethanes have been known to be mixed with rubber pellets, for example, in the construction of playgrounds. In the applications described herein, granular materials, such as non-organic granular materials, may provide added strength and durability relative to organic granular materials that are derived from living matter and therefore may decompose over time.

Other examples of environmental factors that contribute to degradation of existing outdoor, wooden structures include, but are not limited to, UV light exposure. UV light exposure particularly can cause significant damage to existing outdoor wooden structures. UV light exposure can dry out the wooden structure and make the wooden structure more absorbent to water. As water is absorbed by the wood, the water that enters from the top side does not escape and begins a process of decay. To provide protection against these factors, the protective layers described herein cover the existing outdoor wooden structures and inhibit contact between the existing outdoor wooden structure and UV light in the environment. The protective layers described herein also provide an aesthetically pleasing cover to the existing outdoor wooden structure. The top most protective layer is hard, durable and resistant to UV and wear.

By working together, the two protective layers protect the structure from the effects of water, provide for the original wood deck to breathe as originally intended, and provide a flexible and extremely hard-wearing pedestrian walking surface that is aesthetically pleasing, flexible, and blocks UV rays from attacking the wooden structure below. Accordingly, the systems described herein extend the life of the outdoor wooden structure and virtually eliminate heavy maintenance throughout the structures' extended life.

It should be understood that although the examples shown and described herein refer to use of the protective systems on existing outdoor wooden structures, the protective systems shown and described herein may also be used on newly constructed wooden structures.

Figure 1B:
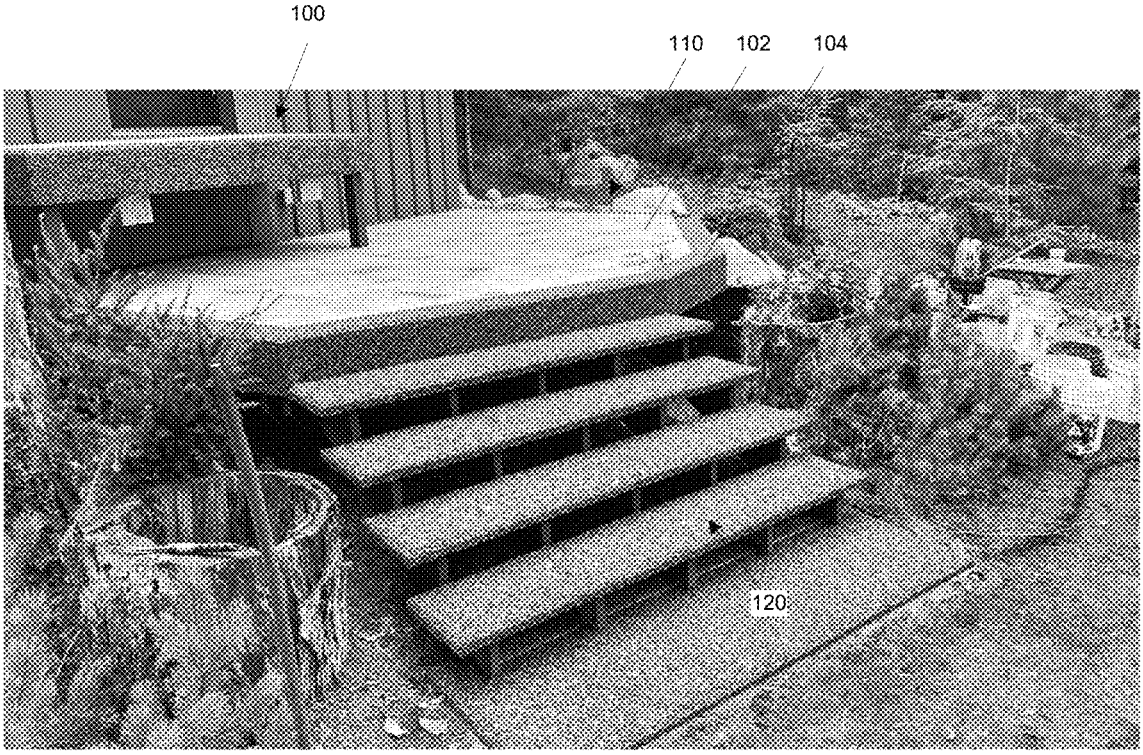
FIG. 1B shows a perspective view of two elevated outdoor wooden structures, each having a plurality of ceramic tiles placed on a top surface thereof and an elastomeric granular composition forming a perimeter around the tiles, and a wooden staircase having the elastomeric granular composition thereon.
Figure 1C:
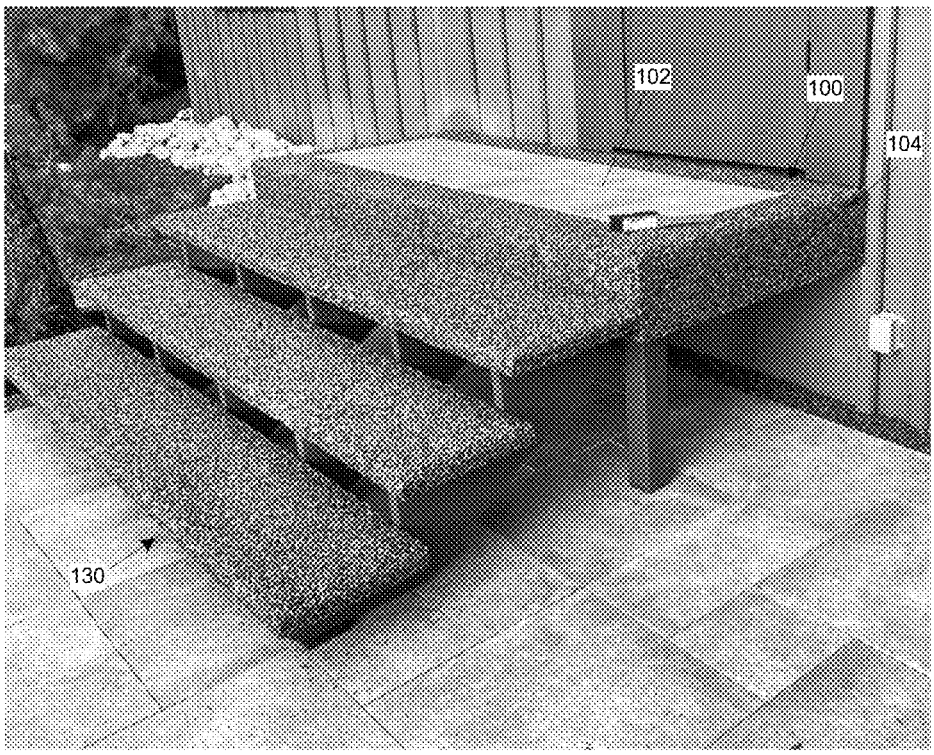
FIG. 1C is a perspective view of one of the elevated outdoor wooden structures of FIG. 1B with another wooden staircase having the elastomeric granular composition thereon.

In accordance with a broad aspect, two-layer protective systems for outdoor wooden structures are described herein. FIG. 1A shows a perspective view of two existing, elevated outdoor wooden structures (e.g. decks) and connecting staircases of the two decks. FIGS. 1B and 1C show examples of two-layer protective systems covering the two existing, elevated outdoor wooden structures and connecting staircases of FIG. 1A.

More specifically, a first protective system 100 and a second protective system 110 are shown in FIGS. 1B and 1C, each having been installed on a different existing outdoor wooden structure. Each of the first protective system 100 and the second protective system 110 includes an upper layer having a plurality of ceramic tiles 102 placed on a top surface of the respective outdoor wooden structure. The plurality of ceramic tiles 102 is surrounded by a perimeter of an elastomeric granular composition 104. Each protective system 100, 110 also includes a lower layer covering at least a portion of the top surface of the wooden structure below the upper layer.

Protective systems 120 and 130 are also shown in FIGS. 1B and 1C having been applied to staircases that are shown in FIG. 1A. Protective systems 120 and 130 each include the elastomeric granular composition 104 covering an existing wooden tread of the staircases. These embodiments are described in greater detail below.

Figure 1D:
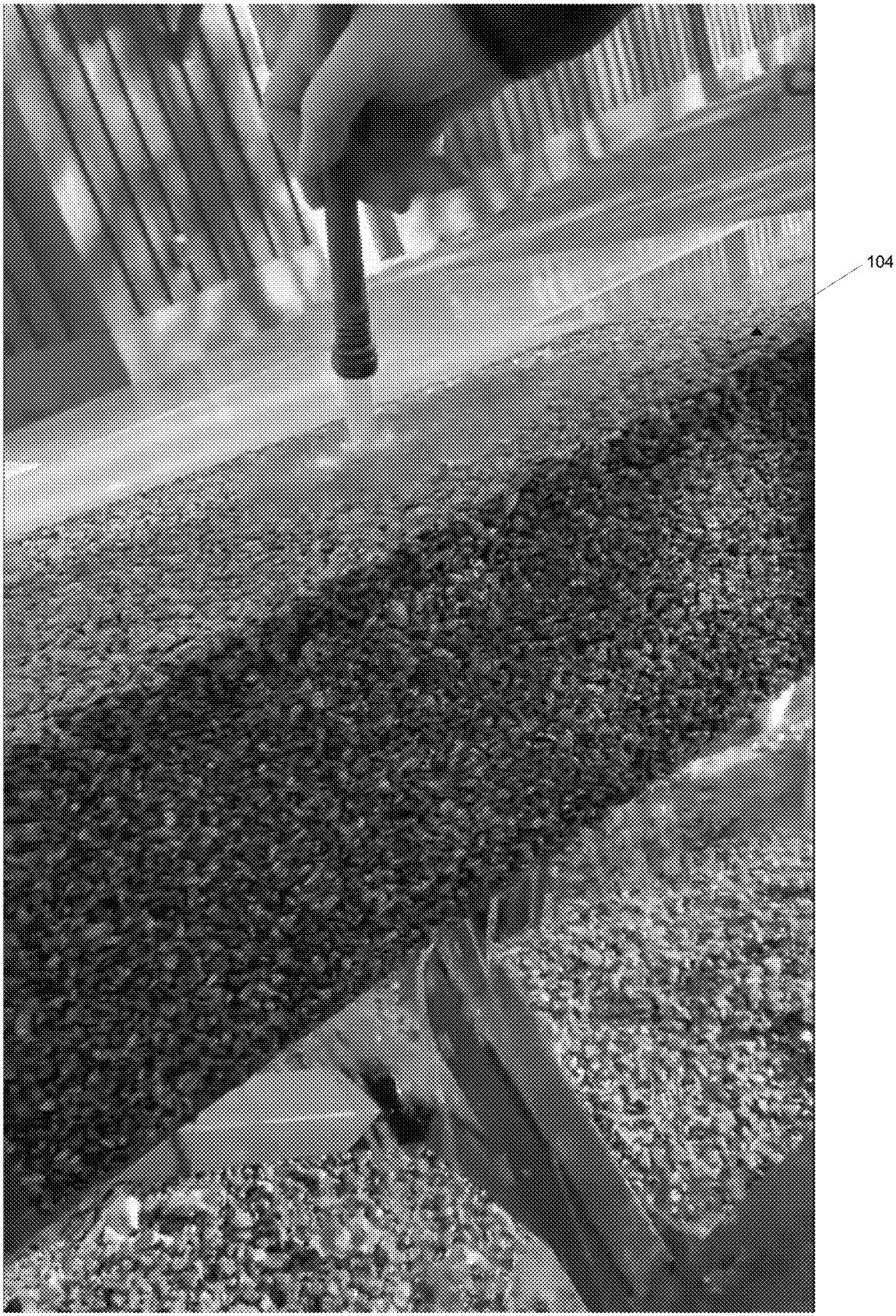
FIG. 1D shows the water permeability of the elastomeric granular composition when cured.

FIG. 1D shows that when water is poured directly on the elastomeric granular composition 104 that a significant portion of the water (i.e. an amount that eliminates any pooling of water on a top surface of the elastomeric granular composition 104) passes directly downwardly and through the elastomeric granular composition 104.

Figure 2A:
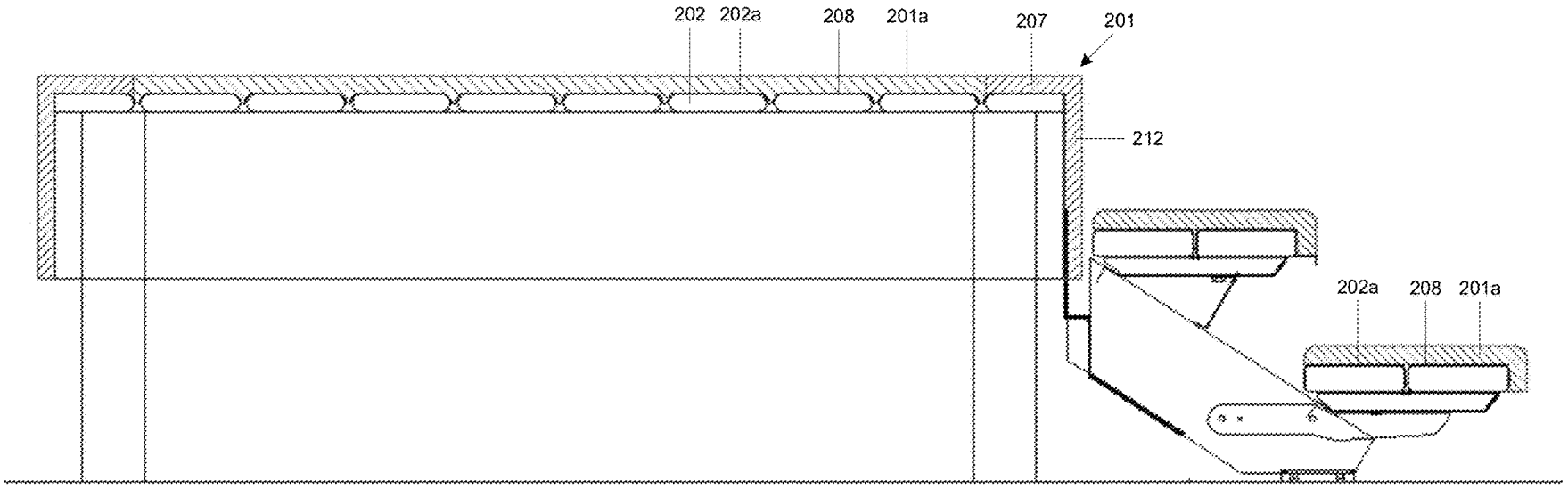
FIG. 2A is a cross-sectional view of a protective system on an outdoor wooden structure, according to at least one embodiment described herein.
Figure 2B:
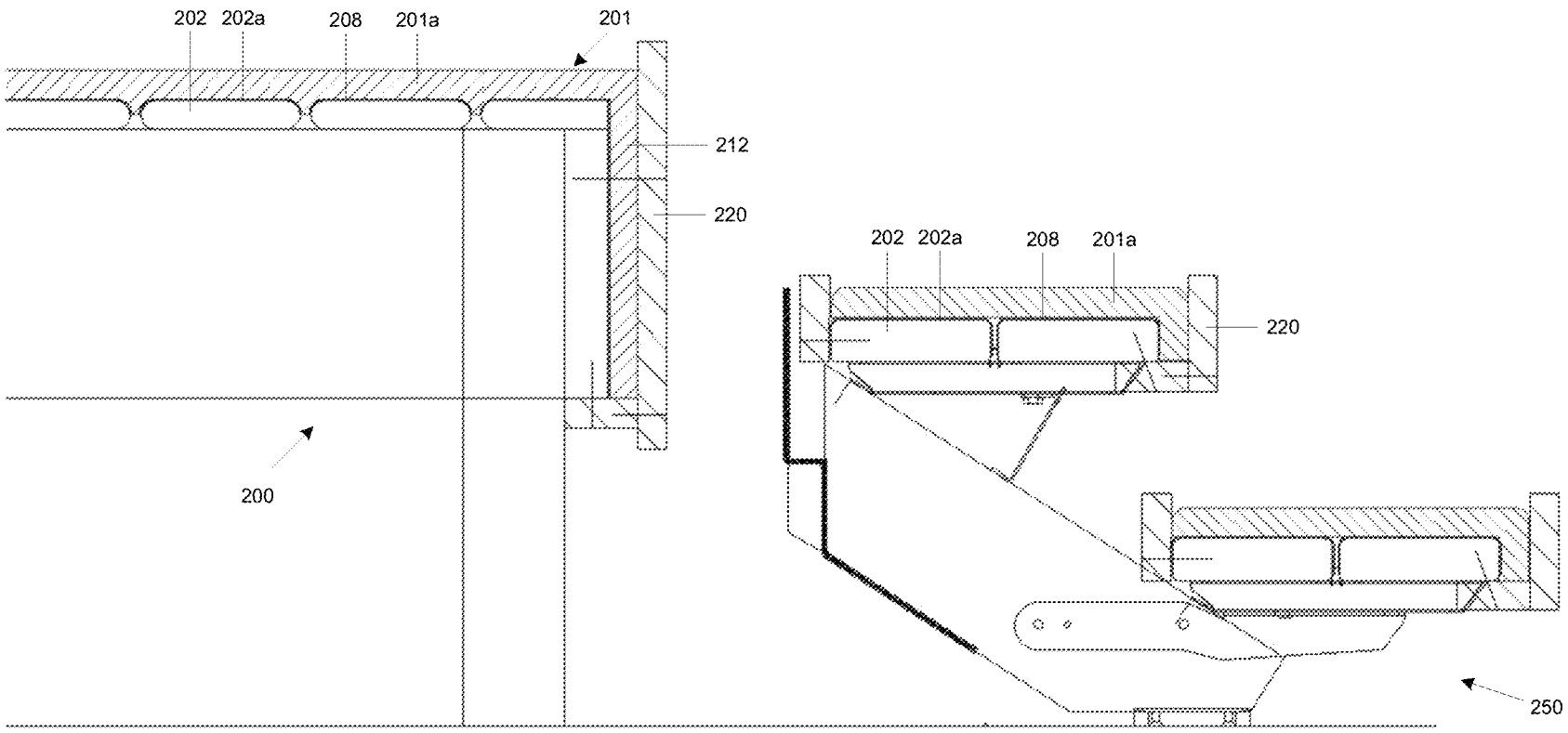
FIG. 2B is a magnified view of a portion of the protective system of FIG. 2A showing forms used for forming the protective system.

FIG. 2A shows a protection system 201 installed on a wooden structure 200. Protective system 201 includes a first layer 208 applied to a top surface 202*a* of deck boards 202 of the wooden structure 200 and a second layer 201*a* comprising an elastomeric granular composition. At least one form (i.e. barrier) 220 is shown enclosing the second layer 201*a* (including skirt 212) for forming the second layer 201*a*. Second layer 201*a* may include a single elastomeric aggregate composition, or alternative may include more than one elastomeric aggregate composition (for example, having different colors from each other). For example, in the example shown, skirt 212 and border 207 may be a different colour than a central portion of second layer 201*a*. Each of these components are each described in greater detail below with reference to FIGS. 3 and 4. For ease of understanding, like elements of FIGS. 2, 3 and 4 have been numbered with like reference numbers with an increment of 100 for each figure set.

Also shown in FIG. 2A is staircase 250 having a two-layer protection system 251 including a second layer 201*a* applied to individual treads of the staircase and a first layer 258. In the embodiments shown, each tread is elevated from a ground surface and formed by two deck boards.

Figure 3A:
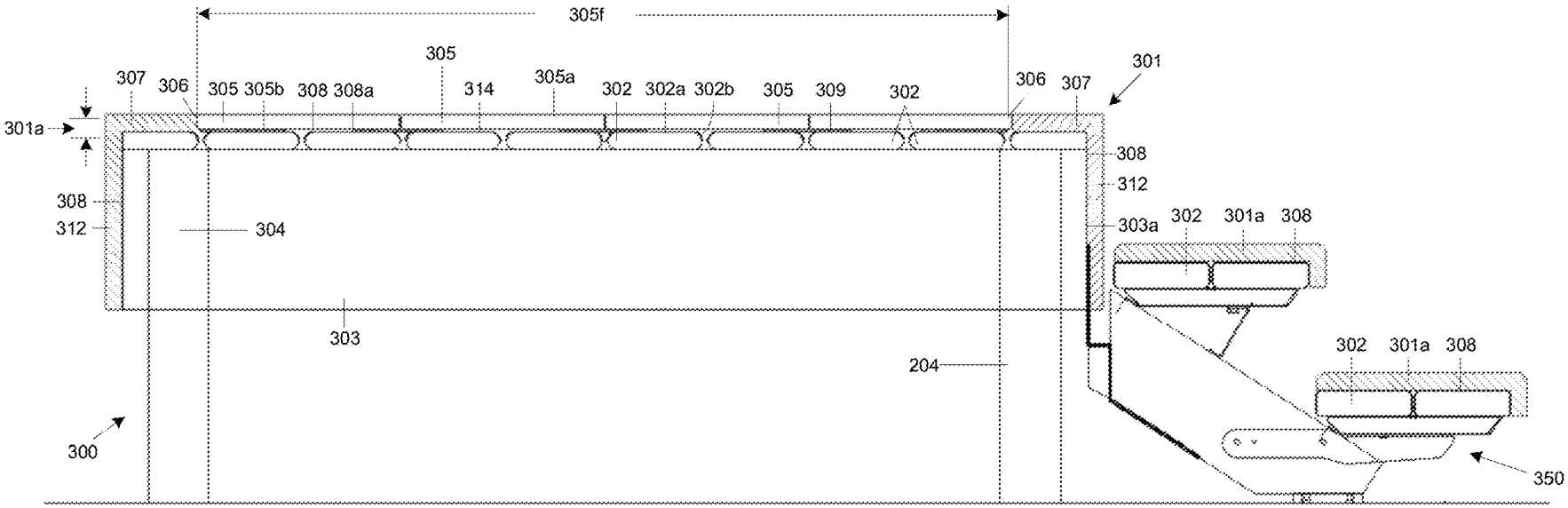
FIG. 3A is a cross-sectional view of a protective system on an outdoor wooden structure, according to at least one embodiment described herein.
Figure 3B:
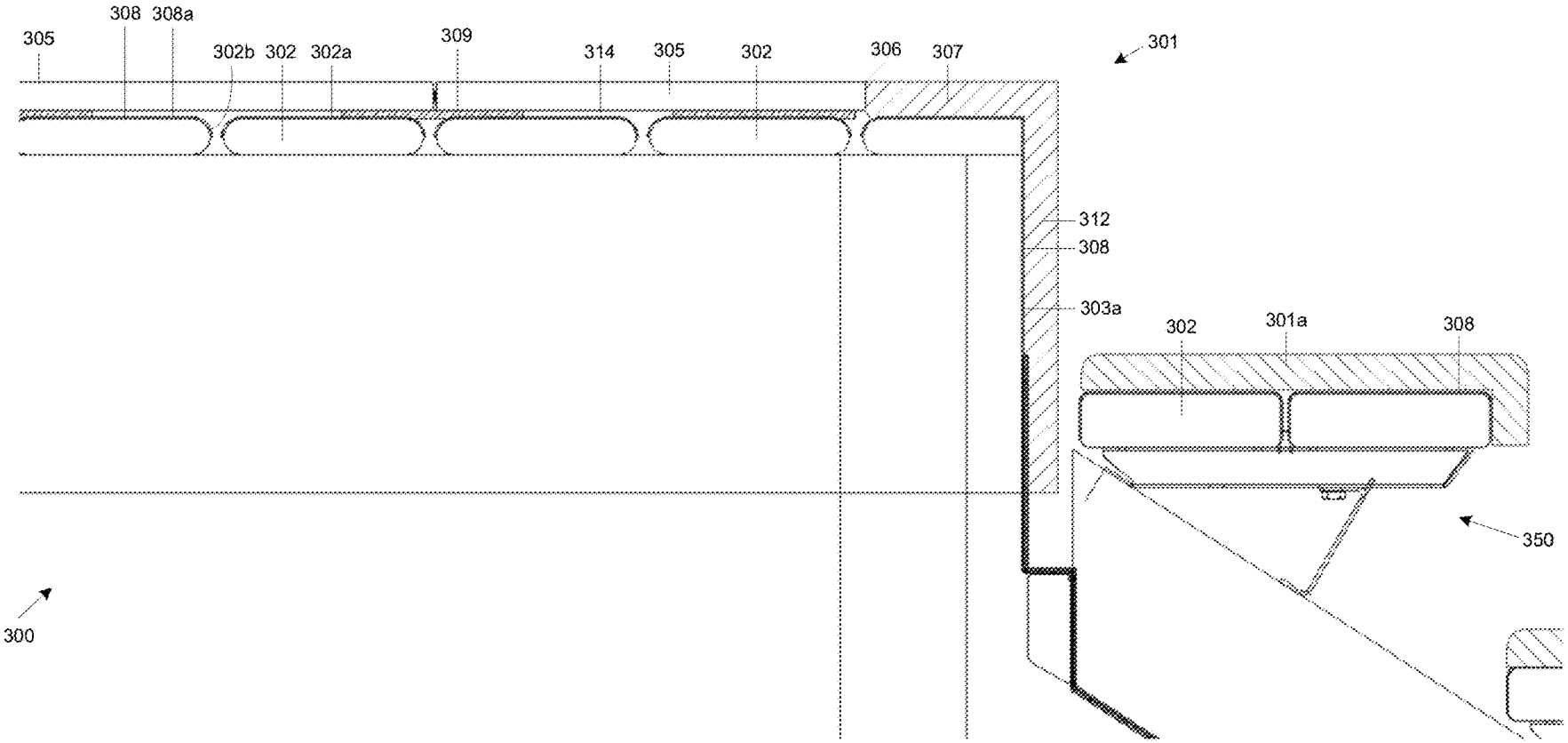
FIG. 3B is a magnified view of a portion of the protective system of FIG. 3A.

FIG. 3A shows a cross-section of an existing outdoor wooden structure 300 with a protective system 301 thereon. In this embodiment, wooden structure 300 is an elevated deck with a plurality of deck boards 302 covering a deck frame 303 supported by posts 304. FIG. 3B shows a magnified view of a portion of the outdoor wooden structure 300 and protective system 301.

Protective system 301 includes a second, or upper, layer 301*a* including plurality of ceramic tiles 305 placed on a top surface 302*a* of deck boards 302. In protective system 301, adjacent tiles of the plurality of ceramic tiles 305 are spaced apart from each other by small composite spacers ranging in thickness of about 0.06 to about 0.12 inches to form a tile field 305*f*. Second layer 301*a* also includes a border 307 of an elastomeric granular composition that at least partially surrounds a perimeter 306 of the tile field 305*f*. Second layer 301*a* may also optionally include a skirt 312 extending downwardly from border 307 and covering at least a portion of a side surface 313 of the existing outdoor wooden structure 300.

Further, protective system 301 also includes a first, or lower, layer 308 covering at least top surface 302*a* of each of the deck boards 302. First layer 308 may optionally cover a side surface 302*b* of one or more of the wooden deck boards 302 and/or a side surface 303*a* of one or more joists of deck frame 303. In at least some embodiments, first layer 308 does not cover a bottom or underside of the deck boards 302.

First layer 308 may be made of any water impenetrable material that is intended to protect the deck boards 302 by inhibiting water from penetrating the wooden deck boards 302. For example, first layer 308 may include a polyurethane-based liquid that cures on the deck boards 302 after being applied to the deck boards 302 (e.g. by brush, roller sprayer or the like). In at least one embodiment, first layer 308 may comprise a polyurethane-based liquid. In at least one embodiment, the polyurethane-based liquid may comprise a diphenylmethane diisocyanate-based polyurethane liquid. In at least one embodiment, the first layer 308 may comprise an extended cure, amber, amorphous binder sold under the trade name Polyval and the product number SL5036. In at least one embodiment, the first layer 308 may comprise a polyurethane, clear aliphatic binder sold under the trade name Polyval and the product number SL8026. In at least one embodiment, the first layer 308 may comprise a single component binder. In at least one embodiment, the first layer 308 may comprise a two-component binder, or a binder having more than two components.

Figure 3C:
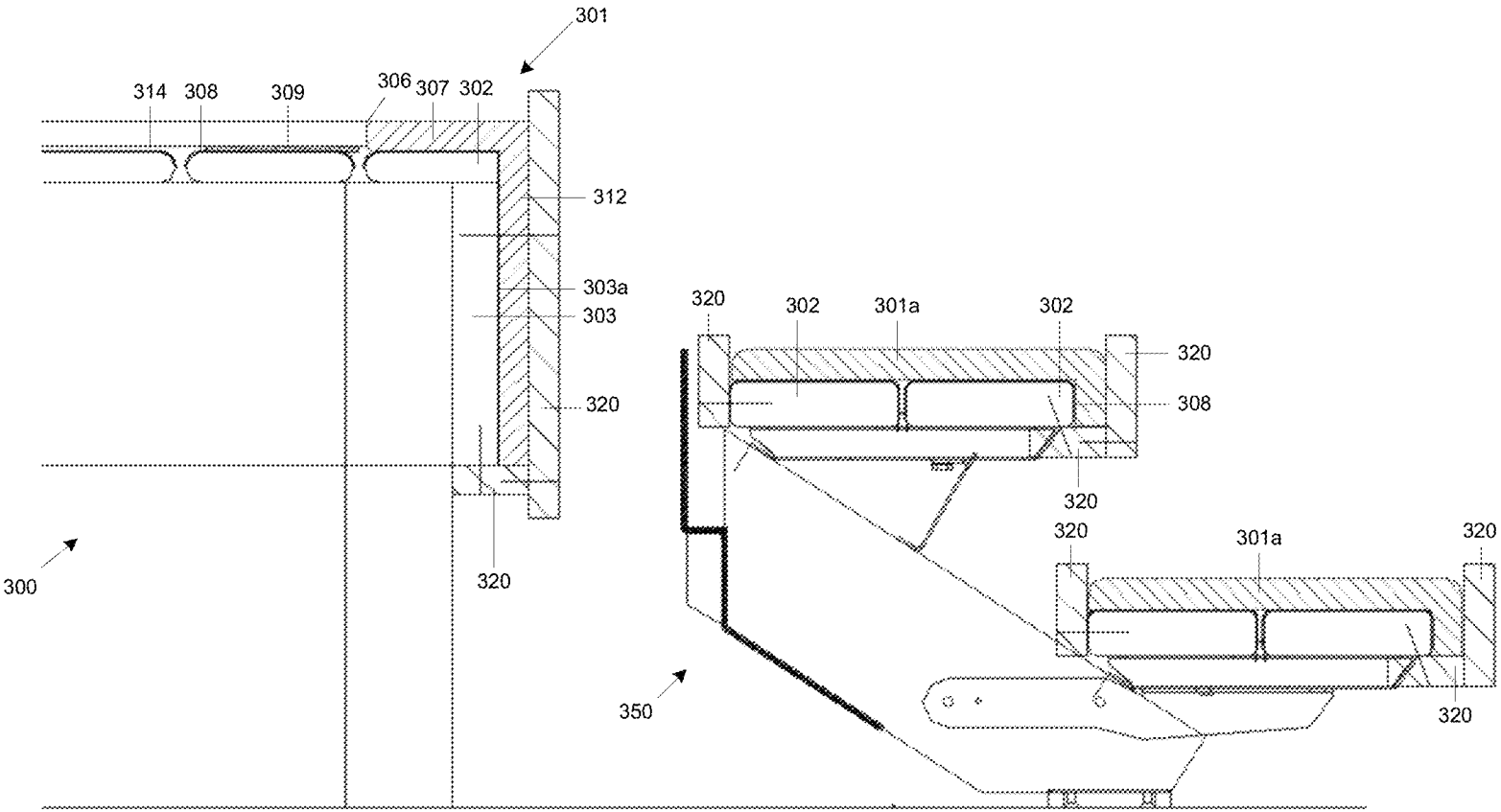
FIG. 3C is a cross-sectional view of a protective system on an outdoor wooden structure having forms built around at least a portion thereof, according to at least one embodiment described herein.

As noted above, second layer 301*a* includes a border 307 comprising an elastomeric granular composition. FIG. 3C shows that the elastomeric granular composition may be placed (e.g. poured in a liquid state) into at least one barrier 320 surrounding at least a portion of the wooden structure 300 and allowed to cure therein to form a rigid border 307 around the at least the tile field 305*f*. In embodiments where second layer 301*a* includes a tile field 305*f* and pads 309, also referred to herein as a floating tile field 305*f*, border 307 surrounds the floating tile field 305*f* to form a containment field that inhibits lateral movement of the floating tile field 305*f*.

In some embodiments, the elastomeric granular composition may also be placed within barrier 320 and cured along a side surface 303*a* of the existing outdoor surface 300. In these embodiments, first layer 308 may be applied to the side surface 303*a* of one or more joists forming deck frame 303 and provide an adhesive function providing for the elastomeric granular composition to adhere to the vertical side surface 303*a*.

Figure 3D:
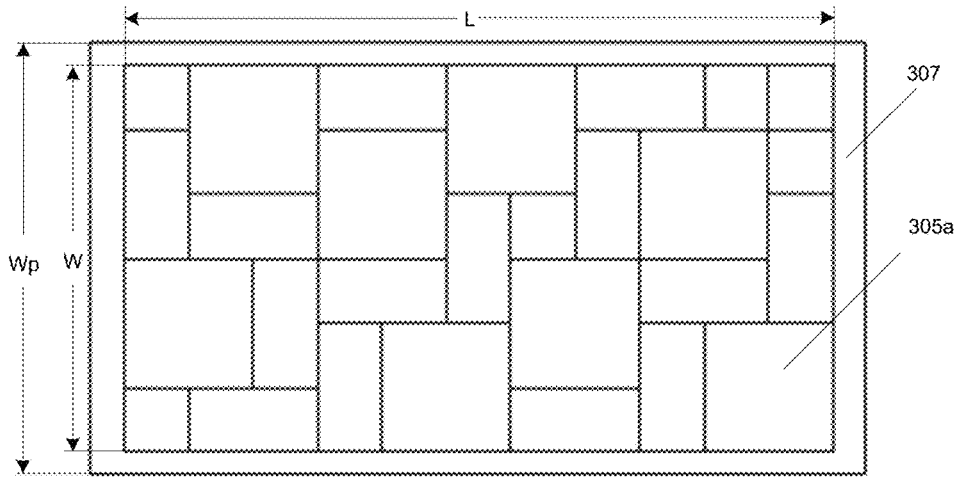
FIG. 3D is a top plan view of a protective system according to at least one embodiment described herein.
Figure 3E:
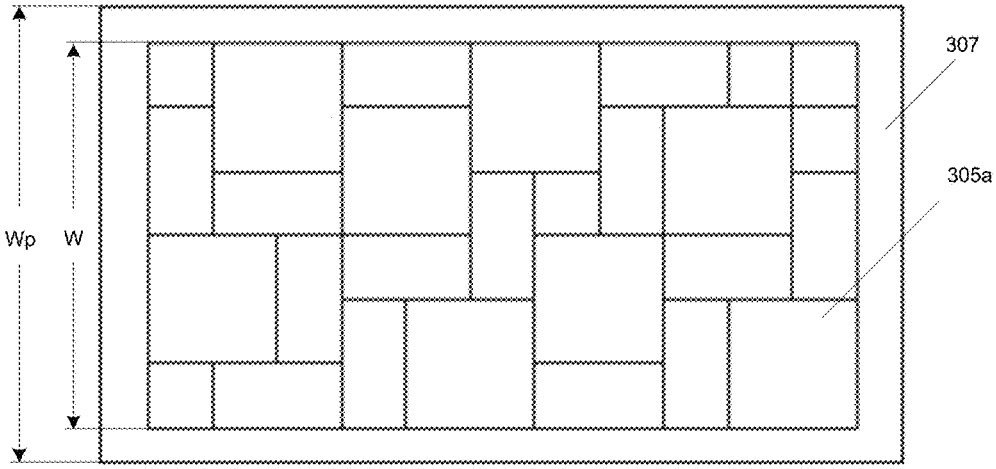
FIG. 3E is a top plan view of a protective system according to at least one embodiment described herein having a larger border width than the system shown in FIG. 3C.
Figure 3F:
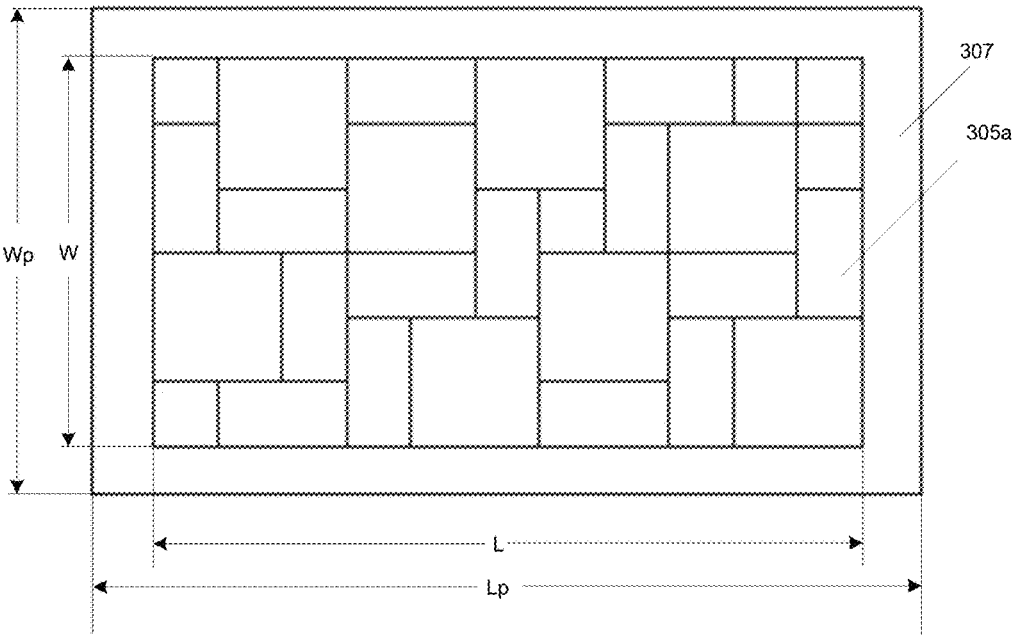
FIG. 3F is a top plan view of a protective system according to at least one embodiment described herein having a larger border width than the systems shown in FIGS. 3C and 3D.

A width and/or length of border 307 may vary depending on the width and provide for the second layer 301*a* to be constructed. For instance, the width and/or length of border 307 may be customized in response to the width and/or length of the existing outdoor wooden structure 300 and the size(s) of the tiles 305 forming tile field 305*f* to inhibit the number of tiles 305 that may need to be cut during installation of tile field 305*f* and to provide for the tile field 305*f* to be centered on the wooden structure 300. For example, referring to FIGS. 3D, 3E and 3F, border 307 is shown having a first width in FIG. 3D, a second width in FIG. 3E that is greater than the width of border 307 in FIG. 3D, and a third width in FIG. 3F that is greater than the widths of borders 307 in FIGS. 3D and 3E. In FIGS. 3D, 3E and 3F, each tile field 305*f* has a same width W and length L, however, the width and/or length of each border 307 differ to accommodate to different widths $W_p$ and lengths $L_p$ of each protective system 301.

The elastomeric granular composition is a mixture of an elastomeric composition and a granular (e.g. aggregate) material. In at least one embodiment, the granular material may include a washed (i.e. substantially free of any dirt or dust) aggregate material. In at least one embodiment, the granular material may have a size (e.g. diameter) in a range of about 0.10 to 0.50 inches.

The elastomeric composition of the elastomeric granular composition may also be a polyurethane-based material, such as but not limited to the polyurethane-based material described above as the protective coating 308. The elastomeric composition of the elastomeric granular composition may therefore be a polyurethane-based liquid, including but not limited to a diphenylmethane diisocyanate-based polyurethane liquid and/or an extended cure binder sold under the trade name Polyval and the product number SL5036. The elastomeric composition of the elastomeric granular composition may also be a polyurethane binder clear aliphatic sold under the trade name Polyval and the product number SL8026. The aliphatic binder may be used in instances where the installer desires to maintain a natural colour of the granular material.

Figure 3G:
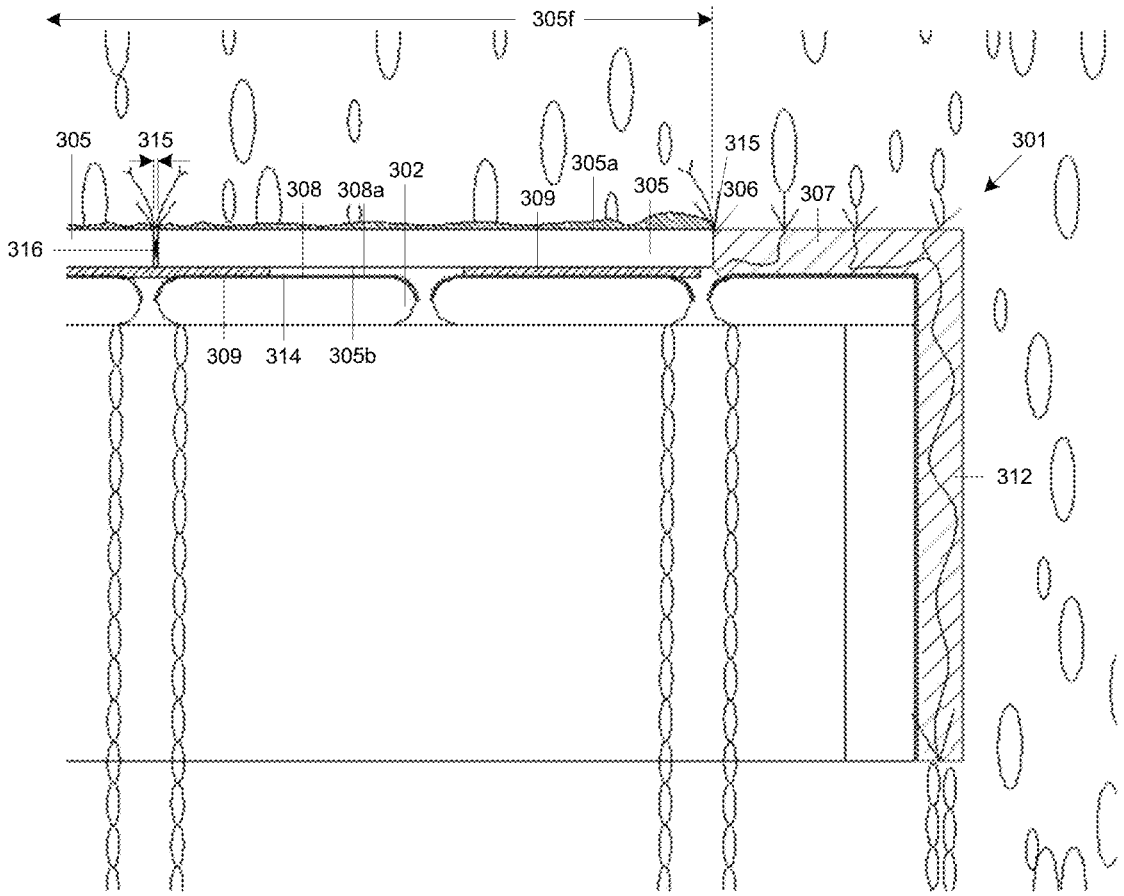
FIG. 3G is a magnified view of a protective system on an outdoor wooden structure showing water travelling through an upper layer of the system, onto a lower layer of the system, and through the outdoor wooden structure, according to at least one embodiment described herein.

The elastomeric composition is generally water impermeable, and the second layer 301*a* is water permeable to provide for water to pass downwardly through the protective layer 301 and onto a top surface 308*a* (see FIG. 3B) of the first layer 308. FIG. 3G shows one example of how water may pass through the systems described herein. As water falls onto a top surface 305*a* of the tiles 305 of the tile field 305*f*, the water may travel laterally across a top surface 305*a* of the tiles towards a gap 315 between adjacent tiles 305 or a gap 315 between a tile 305 and border 307. In embodiments where the elastomeric aggregate composition is not present between adjacent tiles 305, a spacer 316 may be positioned in gap 315 to inhibit lateral movement of the tiles 305 towards each other. Water can then pass downwardly through gap 315 towards top surface 308*a* of the first layer 308. Once water is on the top surface 308*a* of first layer 308, the water, for example, may travel laterally under the ceramic tiles 302 (e.g. in a space 314 created under an underside 305*b* of the tiles 305 and a top surface 308*a* of the first layer 308 by the pads 309) and fall downwardly, either through additional gaps between adjacent deck boards 302 or off an edge of the wooden structure 300. First layer 308 seals the top surface of joints between boards 302 and screw heads, and thereby forces water to evacuate to the side of the deck boards 302 rather than absorbing into the deck boards 302. In embodiments where the elastomeric aggregate composition is present between adjacent tiles 305, water can then pass downwardly through the elastomeric aggregate composition in gap 315 towards top surface 308*a* of the first layer 308, then laterally under the ceramic tiles 302 and downwardly off the structure 300, either through additional gaps between adjacent deck boards 302 or off an edge of the structure 300.

Protective system 301 also includes a plurality of pads 309. Each pad 309 is intended to support and elevate each tile 305 of the plurality of tiles to create space 314 between an underside of each tile 305 and a top surface 308*a* of the first layer 308. In some embodiments, each tile 305 may be unadhered to the pads 309. Tiles 305 being unadhered to the pads 309 may provide for access to the underlying deck frame 303, for example, to provide maintenance. In some embodiments, each tile 305 is may be adhered to one or more pads 309.

The elastomeric granular composition may also be placed between adjacent tiles of the plurality of tiles 305. One embodiment of a protective system having this feature is shown in FIGS. 4A and 4B.

Figure 4A:
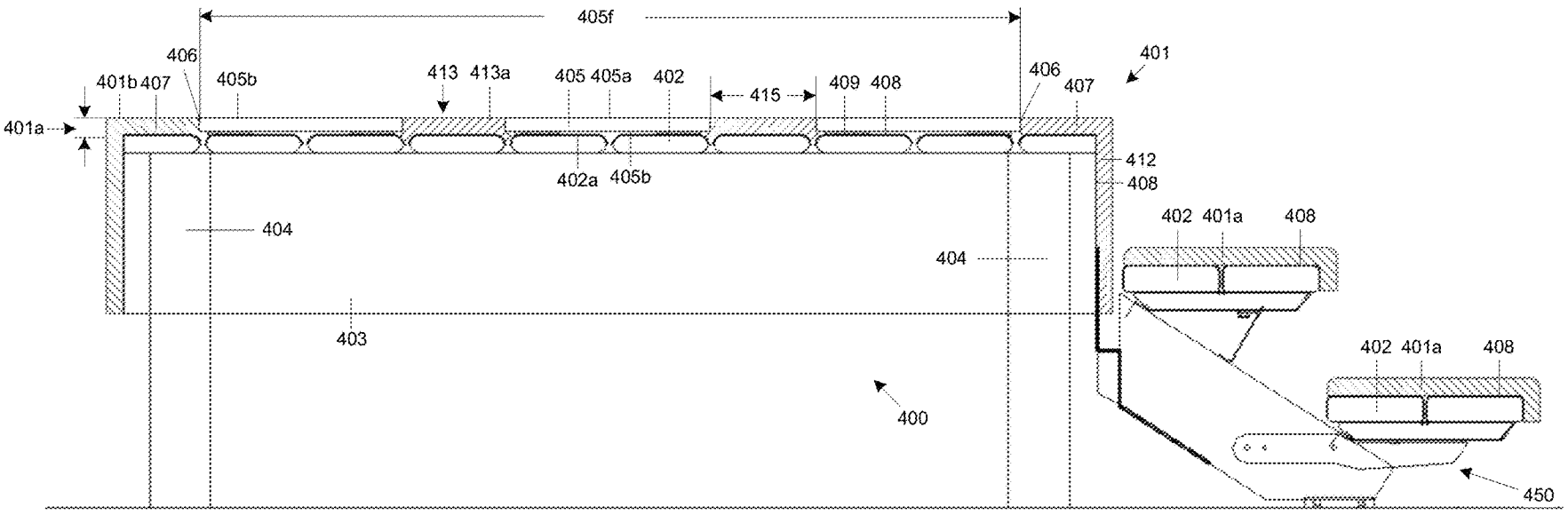
FIG. 4A is a cross-sectional view of a protective system including a water-permeable protective layer on an outdoor wooden structure, according to at least one embodiment described herein.
Figure 4B:
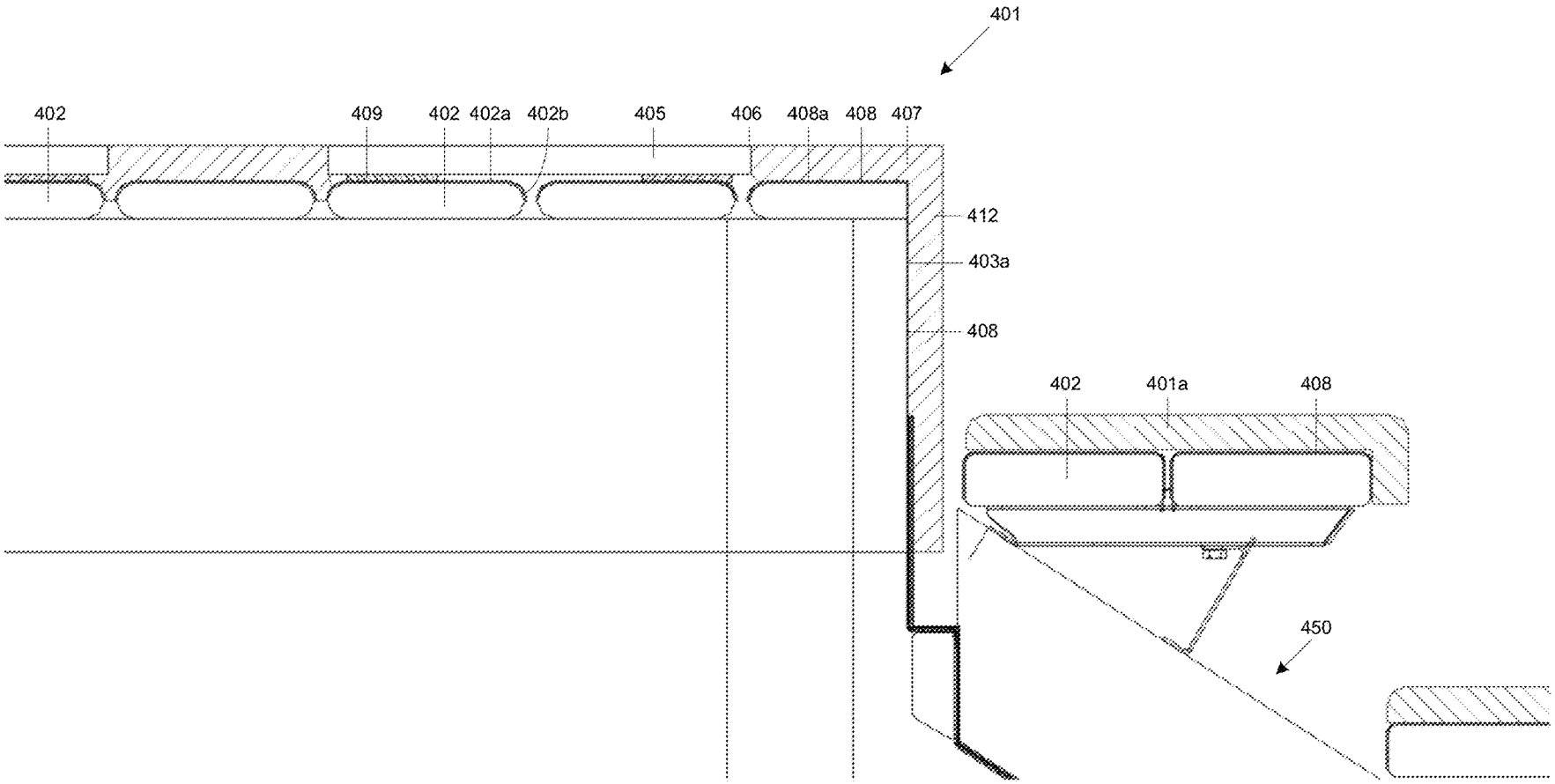
FIG. 4B is a magnified view of a portion of the protective system of FIG. 4A.

FIGS. 4A and 4B show protective system 401, second layer 401*a* includes a border 407 made of the elastomeric granular composition as previously described. Again, border 407 may be formed by elastomeric granular composition being placed in a cavity defined by one or more barriers and at least a portion of the ceramic tiles 405 and the outdoor wooden structure 400. In protective system 401, the adjacent tiles of the plurality of ceramic tiles 405 are spaced apart from each other to form a gap 415 therebetween. Gap 415 is then filled with the elastomeric granular composition to form a joint 413.

In some embodiments, top surface 405*a* of each tile 405 of the plurality of tiles co-operates with each other top surface 405*a* of each other tile 405 to form at least a portion of a top surface 401*b* of protective system 401. In at least some embodiments, a top surface 413*a* of each joint 413 also co-operates with the top surface 405*a* of each tile 405 to form at least a portion of top surface 401*b* of protective system 401.

Methods of Protecting Existing Outdoor Wooden Surfaces

In accordance with a broad aspect, a method of protecting an outdoor wooden structure is also described herein. The method of protecting the outdoor wooden structure includes forming a protective system on the outdoor wooden structure.

Figure 5A:
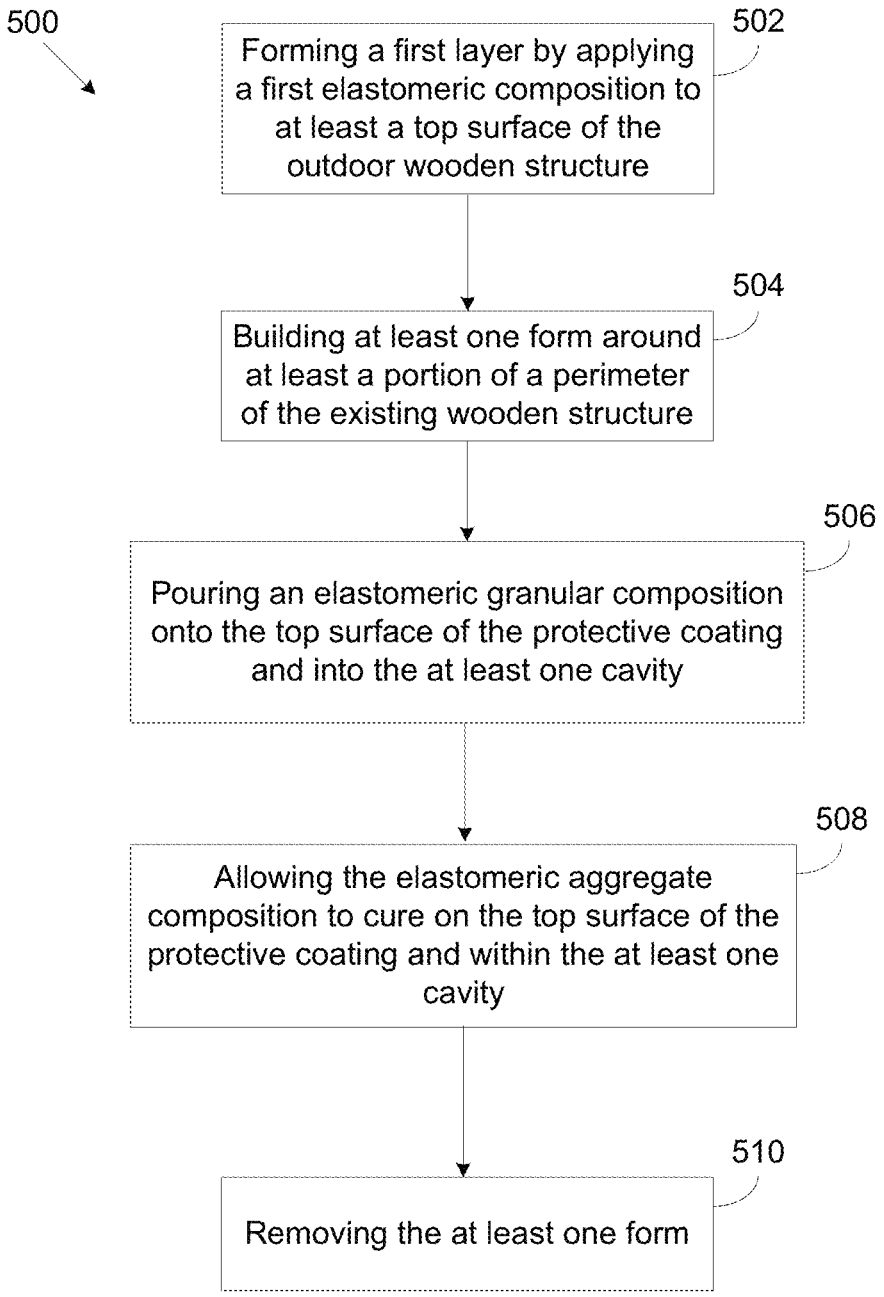
FIG. 5A is a flow chart of a method of forming a protective layer on an outdoor wooden structure, according to at least one embodiment described herein.

FIG. 5A is a block diagram showing a method 400 of protecting an outdoor wooden structure, according to at least one embodiment described herein.

Figure 5B:
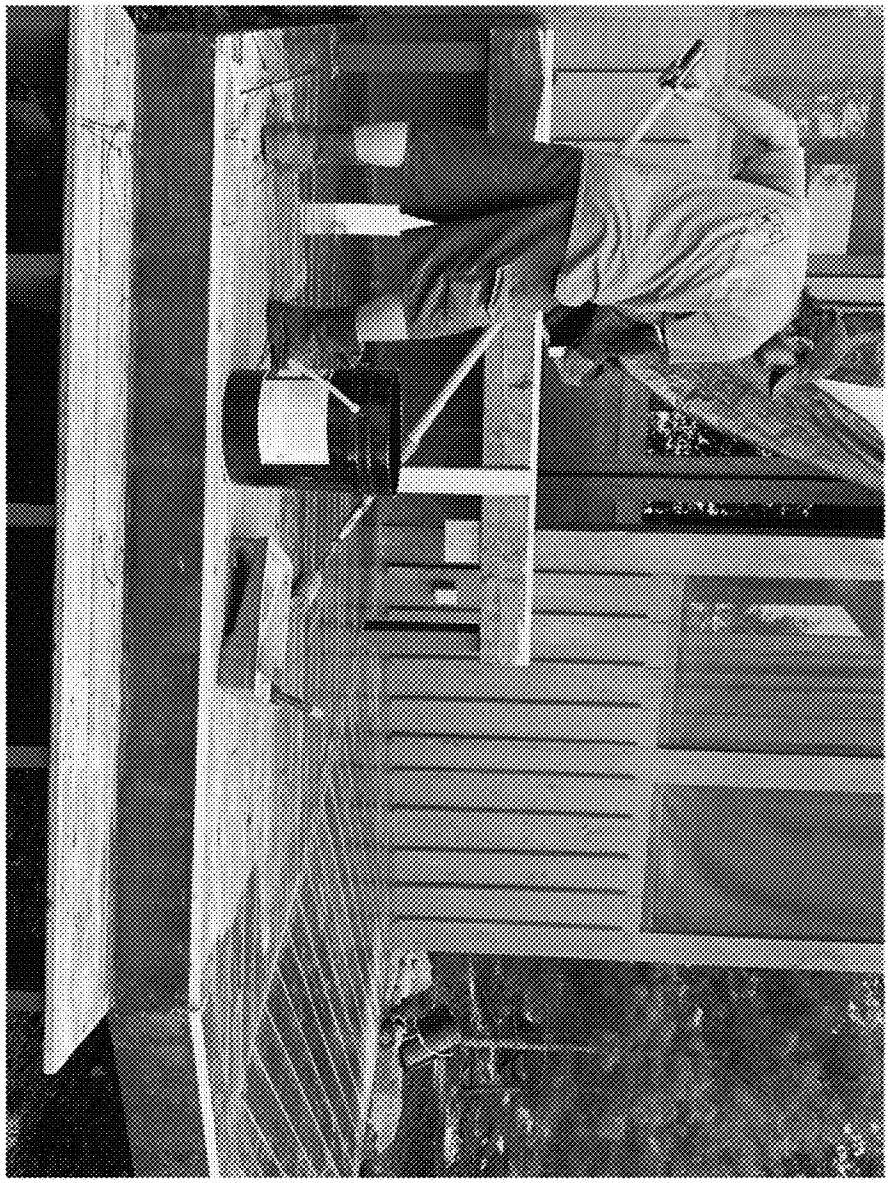
FIG. 5B is a picture showing a protective coating being applied to a top surface of an outdoor wooden structure according to at least one embodiment described herein.

At a first step 502, a first layer is applied to at least a top surface of the outdoor wooden structure. One example of the application of a first layer is shown in FIG. 5B. The first layer may comprise any of the elastomeric compositions described above. Further, the elastomeric composition of the first layer may be applied in any manner known to those skilled in the art, including but not limited to brushing, spraying and rolling the elastomeric composition onto the existing outdoor wooden structure, or a combination thereof. In some embodiments, the first layer may also be applied to at least a portion of a side surface of the existing outdoor wooden structure. In some embodiments, for example when the wooden structure is constructed immediately prior to the protection system being applied to the wooden structure, the elastomeric composition of the first layer may be applied to end cuts of deck boards forming the wooden structure as the wooden structure is being assembled.

Figure 5C:
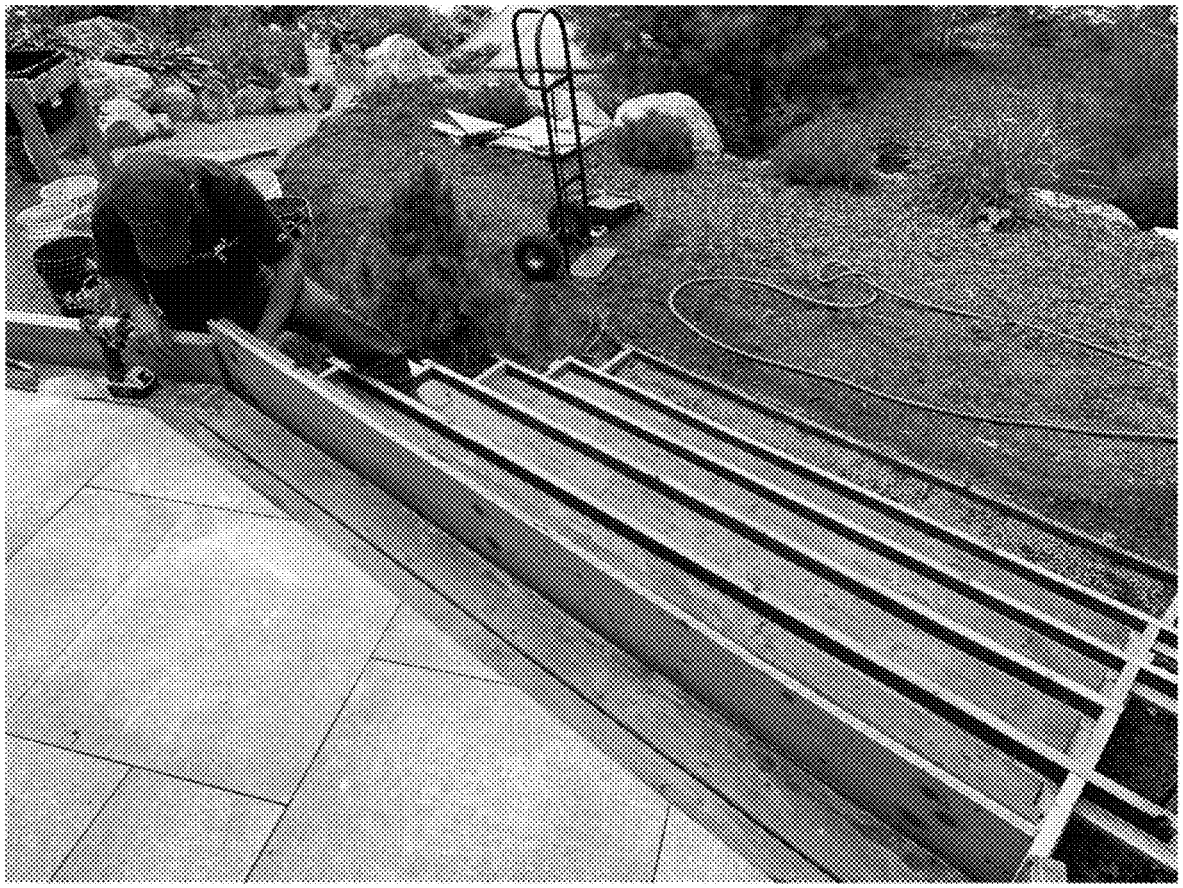
FIG. 5C is a picture showing forms (i.e. a barrier) built around at least a portion of an existing outdoor wooden structure according to at least one embodiment described herein.

After applying the first layer to the surface (e.g. top surface or side surface) of the outdoor wooden structure and allowing the first layer to dry, the method 500 further comprises, at step 504, building at least one barrier around at least a portion of a perimeter of the existing wooden structure. One example of such a barrier is shown in FIG. 5C. The barrier acts to hold the elastomeric granular composition in places as it cures and transitions from a liquid (e.g. a heterogeneous mixture of a fluid with granules suspended therein) to a solid (e.g. a cohesive) material). The barrier may be attached to the existing outdoor wooden structure. In at least one embodiment, the barrier hangs downwardly from a top surface of the existing outdoor wooden structure to provide for a skirt to be created as well as a border around a perimeter of the tile field. The skirt is a portion that hangs downwardly from the border along a side surface of the outdoor wooden structure. The border may have a width in a range of about 1 inch to about 18 inches, or more. The skirt may have a depth in a range of about 2 inches to about 24 inches, or of about 5 inches, or about 18 inches, or about 24 inches. Both the border and the skirt may be about 1 inch thick. In some embodiments, the barrier may be configured to provide for the skirt of elastomeric granular composition to engage and adhere to a side surface of the existing outdoor wooden structure. In some embodiments, the barrier may surround the existing outdoor wooden structure.

After the barrier(s) are built, the elastomeric granular composition may be created by mixing a granular material with an elastomeric composition. Each of the materials for forming the elastomeric granular composition is described in greater detail above. The mixing of the granular material with the elastomeric composition may be by, for example, using a mortar mixer, by hand or by any other method known to those skilled in the art. Large mortar mixers have a stationary barrel and an internal paddle with a rubber strip. As the paddle rotates, it mixes the mortar while scraping the barrel's sides. In the embodiments described herein, the movement of the internal paddle may provide for the elastomeric composition to form a thin coat on the granular material.

The mixing occurs over a pre-determined period of time and provides for the elastomeric granular composition to coat at least a majority of each granule of the granular material to encourage the granular material to stick together.

Figure 5D:
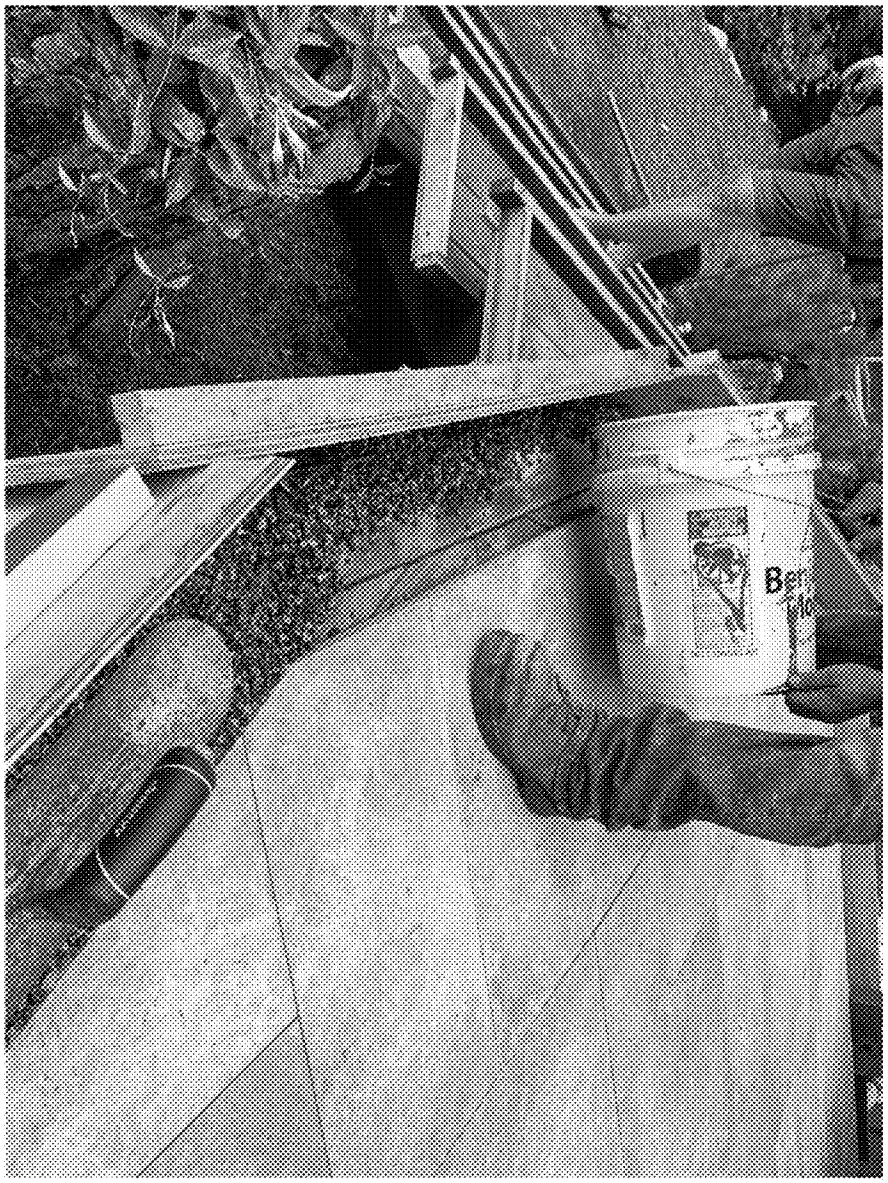
FIG. 5D is a picture showing an elastomeric granular composition being poured into a cavity defined by a barrier built around at least a portion thereof according to at least one embodiment described herein.

At a third step 506, method 500 includes pouring the elastomeric granular composition onto at least a portion of the top surface of the first layer and/or into the barrier(s). One example of this is shown in FIG. 5D. The barrier(s) provides a cavity for holding the elastomeric granular composition in place until it cures.

In at least one embodiment, before pouring the elastomeric granular composition onto at least a portion of the top surface of the first layer, a plurality of tiles may be placed on a top surface of the outdoor wooden structure. In some embodiments, the tiles may be ceramic tiles (e.g. about 0.75 inches thick) that are spaced apart from each other to form gaps between adjacent tiles. In some embodiments, spacers may be temporarily placed between the tiles to maintain a selected distance between the tiles as the elastomeric granular composition is placed between the adjacent tiles. For example, the selected distance may be in a range of about 0.50 inches to about 12 inches. The selected distance may vary depending on the size (e.g. length and width) of the tiles. In some embodiments, the tiles may be placed by a distance in a range of about 0.06 to about 0.12 inches to provide for water to pass downwardly between the tiles. In other embodiments, the spacers may remain in the gaps between the tiles to inhibit the tiles from moving laterally towards each other.

Figure 5E:
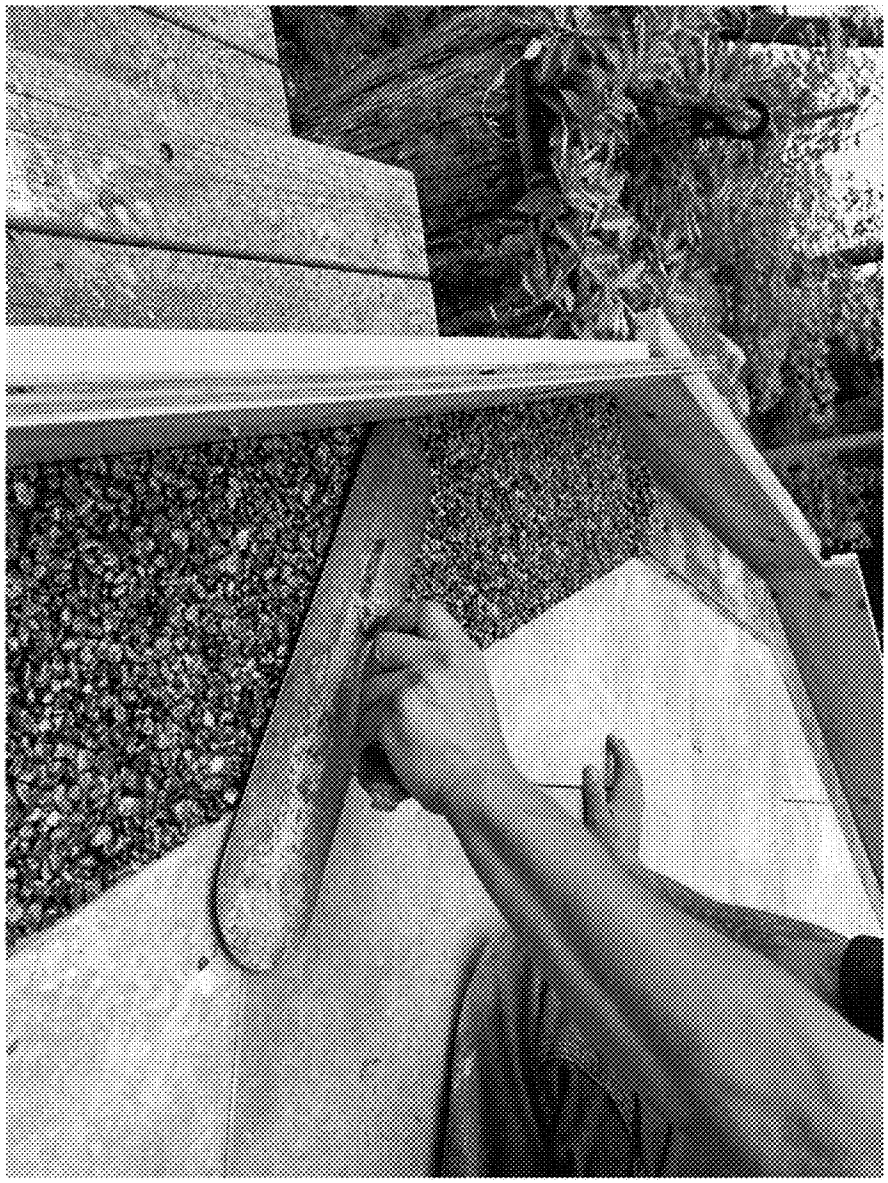
FIG. 5E shows a picture of levelling the elastomeric granular composition shown being poured in FIG. 5D.

It should be understood that in embodiments where the elastomeric granular composition is poured into gaps between the tiles, the elastomeric granular composition may fill the gaps between the tiles and co-operate with a top surface of each of the tiles to form a top surface of the second layer. Optionally, the elastomeric granular composition may be worked to form a planar layer, for example as shown in FIG. 5E.

At a fourth step 508, after placing the elastomeric granular composition onto the first layer, the elastomeric granular composition is left to cure to form the second layer.

At a fifth step 510, once the elastomeric granular composition has cured, the barrier(s) are removed and the elastomeric granular composition will remain attached to the outdoor wooden structure. In at least one embodiment, the elastomeric composite material cures within about 24 hours.

Once cured, the elastomeric granular composition forms the second layer on the outdoor wooden structure.

In some embodiments, the methods and compositions described herein may form a continuous protective system on a surface of the outdoor wooden structure. In other embodiments, a discontinuous protective system may be formed on the outdoor wooden structure using the methods and compositions described herein.

While the above description provides examples of one or more apparatus, methods, or systems, it will be appreciated that other apparatus, methods, or systems may be within the scope of the claims as interpreted by one of skill in the art.

What is claimed is:

1. A two-layer protective system for an outdoor wooden structure, the two-layer protective system comprising:

a first layer covering at least a portion of a top surface of the outdoor wooden structure, the first layer being a water-impermeable layer comprising a first elastomeric composition to inhibit water from contacting the top surface of the wooden structure; and a second layer placed on a top surface of the first layer, the second layer being a water-permeable layer that includes an elastomeric granular composition comprising:

a second elastomeric composition; and a granular material, the second elastomeric composition coating at least a majority of each granule of the granular material to encourage the granular material to stick together at contact points and to provide for water to pass through pores formed between the contact points.

2. The protective system of claim 1, wherein:

the second layer further includes a plurality of tiles placed on the top surface of the first layer; and the elastomeric granular composition surrounds at least a portion of the plurality of tiles to form a containment field to inhibit the tiles from moving laterally.

3. The protective system of claim 2, wherein the plurality of tiles are spaced apart from one another on the top surface of the first layer to form gaps therebetween.

4. The protective system of claim 3, wherein the system further comprises spacers positioned in the gaps.

5. The protective system of claim 3, wherein the elastomeric granular composition is positioned in the gaps.

6. The protective system of claim 3 further comprising a plurality of pads positioned below the plurality of tiles and on the top surface of the first layer to create a space between a bottom surface of each of the tiles and the top surface of the first layer, the pads having a height sufficient to provide for water to pass through the space and across the top surface of the first layer.

7. The protective system of claim 5, wherein a top surface of each of the plurality of tiles co-operates with each other tile of the plurality of tiles to form at least a portion of a top surface of the protective system, and the elastomeric granular composition in the gaps between the tiles also forms at least a portion of the top surface of the protective system.

8. The protective system of claim 1, wherein the first layer covers at least a portion of a side surface of the outdoor wooden structure.

9. The protective system of claim 8, wherein the second layer includes a skirt extending downwardly in front of at least the portion of the first layer on the side surface of the outdoor wooden structure.

10. The protective system of claim 1, wherein the second composition comprises a urethane and the urethane is configured to withstand a plurality of freeze thaw cycles without losing elasticity.

11. The protective system of claim 1, wherein the granular material comprises a washed aggregate material.

12. The protective system of claim 1, wherein the elastomeric granular composition includes about 20 parts of the granular material and about 1 part of the second elastomeric composition.

13. A wooden outdoor structure comprising:

a deck frame supported above a ground by a plurality of deck posts; and the two-layer protective system of claim 1 covering at least a portion of a top surface of the deck frame.

* * * * *